US008498566B2

(12) United States Patent
Shoji et al.

(10) Patent No.: US 8,498,566 B2
(45) Date of Patent: Jul. 30, 2013

(54) IMAGE FORMING APPARATUS

(75) Inventors: Yutaka Shoji, Ibaraki-Pref (JP); Junji Shirakawa, Ibaraki-Pref (JP); Takayuki Muneyasu, Ibaraki-Pref (JP)

(73) Assignee: Ricoh Company, Limited, Tokyo (JP)

( * ) Notice: Subject to any disclaimer, the term of this patent is extended or adjusted under 35 U.S.C. 154(b) by 804 days.

(21) Appl. No.: 12/076,609

(22) Filed: Mar. 20, 2008

(65) Prior Publication Data

US 2008/0232866 A1 Sep. 25, 2008

(30) Foreign Application Priority Data

Mar. 23, 2007 (JP) ..... 2007-076591

(51) Int. Cl.
*G03G 15/00* (2006.01)

(52) U.S. Cl.
USPC ..... 399/388; 399/162; 399/303; 399/391; 399/394

(58) Field of Classification Search
USPC ..... 399/388, 394, 162, 391, 392, 397, 399/303, 393; 271/236
See application file for complete search history.

(56) References Cited

U.S. PATENT DOCUMENTS

| | | | | |
|---|---|---|---|---|
| 6,602,008 | B2 * | 8/2003 | Yamagishi et al. | 400/619 |
| 7,396,175 | B2 * | 7/2008 | Ueda | 400/708 |
| 2001/0014235 | A1 * | 8/2001 | Ando et al. | 399/395 |
| 2005/0156374 | A1 * | 7/2005 | Siegel et al. | 271/258.01 |

FOREIGN PATENT DOCUMENTS

| | | |
|---|---|---|
| JP | 2893540 | 3/1999 |
| JP | 2002-265097 | 9/2002 |
| JP | 2003-066686 | 3/2003 |
| JP | 2006-343629 | 12/2006 |
| JP | 2007-047842 | 2/2007 |

OTHER PUBLICATIONS

Abstract of JP Publication 03-94275 published Apr. 19, 1991.
Office Action dated Aug. 3, 2010 issued in corresponding Japanese Application No. 2007-076591.

* cited by examiner

*Primary Examiner* — Matthew G Marini
(74) *Attorney, Agent, or Firm* — Harness, Dickey & Pierce P.L.C.

(57) ABSTRACT

An image forming apparatus includes a belt-shaped image carrier that carries an image, an image transfer unit that transfers the image onto a recording medium, and a conveying unit that conveys the recording medium to the image transfer unit. The image carrier has a sloping surface that slopes down from an upstream of the image transfer unit in a conveying direction. The conveying unit includes a linear conveying path that is arranged an upstream of the image transfer unit in the conveying direction, below the sloping surface and above a horizontal line passing through the image transfer unit.

22 Claims, 5 Drawing Sheets

IMAGE FORMING APPARATUS

CROSS-REFERENCE TO RELATED APPLICATIONS

The present application claims priority to and incorporates by reference the entire contents of Japanese priority document 2007-076591 filed in Japan on Mar. 23, 2007.

BACKGROUND OF THE INVENTION

1. Field of the Invention

The present invention relates to an image forming apparatus.

2. Description of the Related Art

Among image forming apparatuses such as copiers and printers, well known are those including a belt-shaped image carrier such as an intermediate transfer belt or a photosensitive belt. For example, Japanese Patent Application Laid-open No. 2006-343629 discloses a conventional image forming apparatus including such an image carrier. The conventional image forming apparatus includes an image transfer unit and a conveying unit. The conveying unit conveys a recording medium to the image transfer unit at such timing that the image transfer unit can accurately transfer an image carried on the image carrier onto a desired position of the recording medium without misalignment.

Japanese Patent No. 2893540 discloses a conventional technology, in which, after the leading edge of a recording medium bumps into a gate member and is positioned, the recording medium is held between the registration rollers located downstream of the gate member. The registration rollers are moved in a width direction while holding the recording medium, so that misalignment of the recording medium in its width direction (in a direction perpendicular to its conveying direction) is corrected. The recording medium is then conveyed to an image transfer unit.

Japanese Patent Application Laid-open No. 2002-265097 discloses another conventional technology, in which, after a recording medium bumps into a gate member (a surface of the gate member) and skew thereof is corrected the recording medium is conveyed to an image transfer unit by a pair of registration rollers located upstream of the gate member.

In the conventional technologies, a surface of the belt-shaped image carrier is arranged to slope from upstream in the conveying direction to the image transfer unit. However, a conveying path to the image transfer unit is arranged to be substantially level in the conveying unit, resulting in waste of space between the image carrier and the conveying unit.

Because of a recent demand for a more compact image forming apparatus in which a recording medium is conveyed at high speed, there is need of a technology for efficiently utilizing space.

SUMMARY OF THE INVENTION

It is an object of the present invention to at least partially solve the problems in the conventional technology.

According to an aspect of the present invention, there is provided an image forming apparatus including an image carrier that moves in a predetermined direction while carrying an image; a transfer unit that transfers the image carried on the image carrier onto a recording medium; and a conveying unit that conveys the recording medium to the transfer unit. The image carrier has a sloping surface that slopes down from upstream of the transfer unit in a conveying direction in which the recording medium is conveyed. The conveying unit includes a first conveying path that is linear and arranged upstream of the transfer unit in the conveying direction between the sloping surface and a horizontal line passing through the transfer unit.

The above and other objects, features, advantages and technical and industrial significance of this invention will be better understood by reading the following detailed description of presently preferred embodiments of the invention, when considered in connection with the accompanying drawings.

DETAILED DESCRIPTION OF THE PREFERRED EMBODIMENTS

Figure 1:
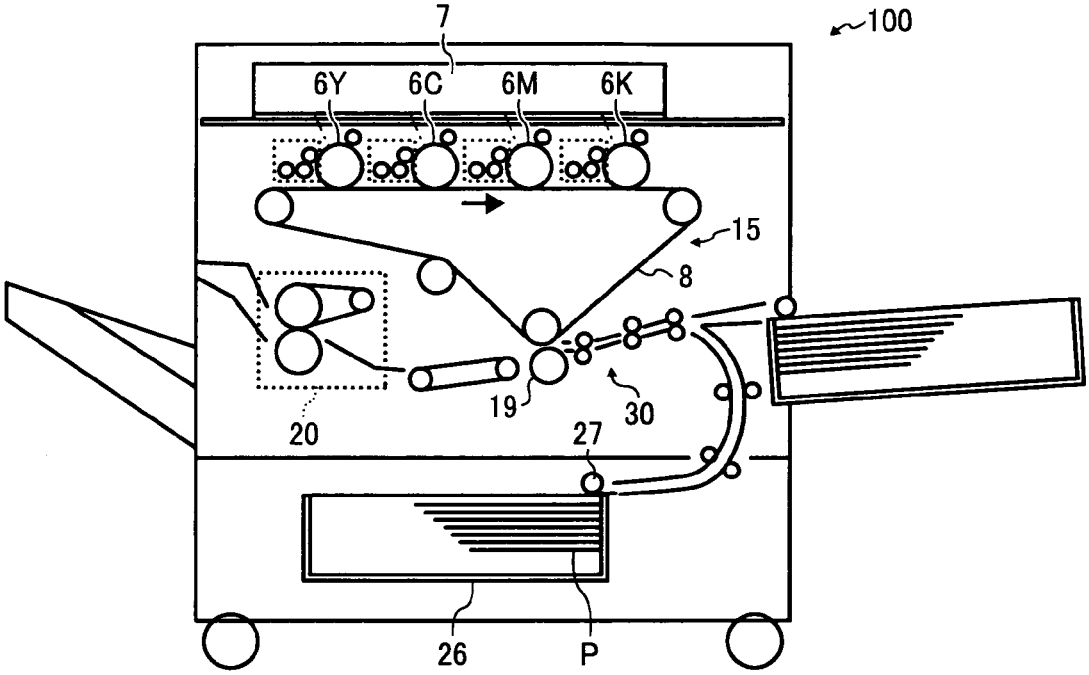
FIG. 1 is a schematic diagram of an image forming apparatus according to a first embodiment of the present invention.

Exemplary embodiments of the present invention are explained in detail below with reference to the accompanying drawings. Like reference numerals refer to corresponding elements throughout the several views of the drawings, and the explanation thereof is not repeated or simplified as appropriate.

FIG. 1 is a schematic diagram of an image forming apparatus 100 according to a first embodiment of the present invention. While the image forming apparatus 100 is explained below as a printer, it can be a copier, a facsimile machine, a scanner, and a multifunction product (MFP) that combines any or all of functions of these. The image forming apparatus 100 includes an intermediate transfer belt device 15, image forming units 6Y, 6M, 6C, and 6K, and a conveying unit 30. The intermediate transfer belt device 15 is arranged in the center of the image forming apparatus 100. The image forming units 6Y, 6M, 6C, and 6K correspond to different colors of yellow, magenta, cyan, and black, respectively, and are arranged in parallel to face an intermediate transfer belt 8 of the intermediate transfer belt device 15. The conveying unit 30 is arranged at the lower right of the intermediate transfer belt device 15.

The image forming units 6Y, 6M, 6C, and 6K are of like configuration and operates in the same manner except for toner color they use, and thus but one of them, the image forming unit 6Y, is described in detail below.

Figure 2:
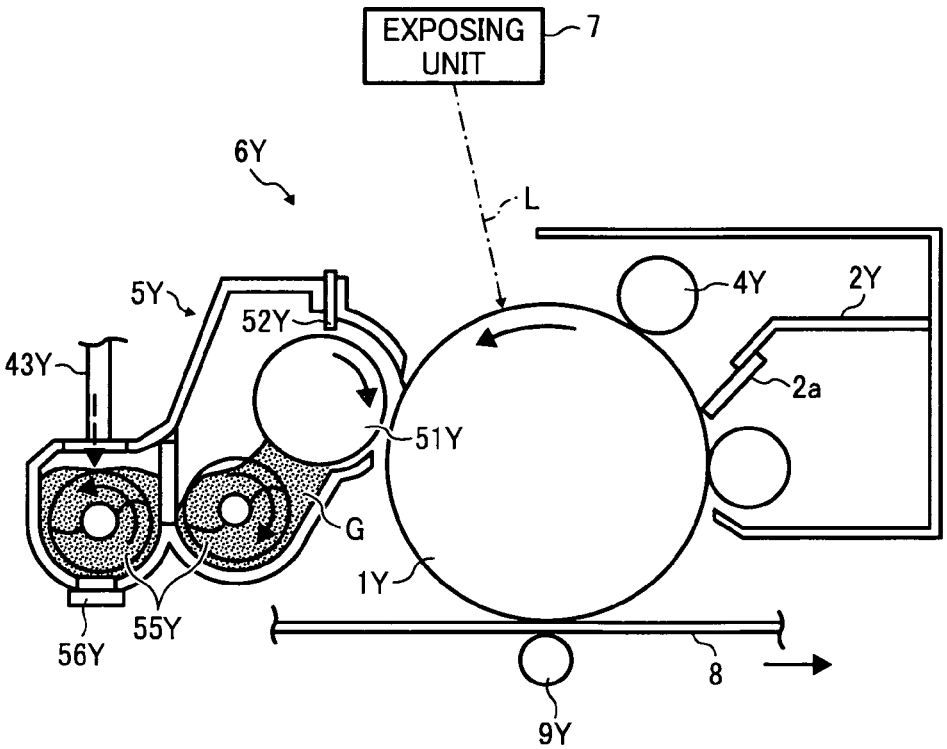
FIG. 2 is a cross section of an image forming unit shown in FIG. 1.

As shown in FIG. 2, the image forming unit 6Y includes a photosensitive drum 1Y serving as an image carrier and a charging unit 4Y, a developing unit 5Y, a cleaning unit 2Y, and a neutralizing unit (not shown) that are arranged around the photosensitive drum 1Y. An image forming process (charging, exposing, developing, transferring, and cleaning) is performed on the photosensitive drum 1Y to form a yellow image on the photosensitive drum 1Y.

The photosensitive drum 1Y is driven to rotate counterclockwise in FIG. 2 by a driving motor (not shown). A surface of the photosensitive drum 1Y is uniformly charged by the charging unit 4Y. The surface of the photosensitive drum 1Y is then irradiated or scanned with a laser beam L emitted from an exposing unit 7. Thus, a yellow electrostatic latent image is formed on the surface of the photosensitive drum 1Y.

The electrostatic latent image is developed into a yellow toner image by the developing unit 5Y. With the rotation of the photosensitive drum 1Y, the electrostatic latent image reaches a position corresponding to the intermediate transfer belt 8 and a transfer roller 9Y. The toner image is transferred (primarily transferred) onto the intermediate transfer belt 8 by the transfer roller 9Y. At this time, residual toner remains on the photosensitive drum 1Y.

The residual toner is removed by a cleaning blade 2*a* and collected into the cleaning unit 2Y. After that, remaining potential is removed from the surface of the photosensitive drum 1Y by the neutralizing unit. In this manner, the image-forming process is performed on the photosensitive drum 1Y.

The image-forming process is also performed in the other image forming units 6M, 6C, and 6K in the same manner as described above for the yellow image forming unit 6Y. That is, photosensitive drums 1M, 1C, and 1K in the image forming units 6M, 6C, and 6K are also irradiated with a laser beam L emitted from the exposing unit 7 arranged above each of the image forming units 6M, 6C, and 6K.

Specifically, the exposing unit 7 emits a laser beam L based on image data from a light source, and each of the photosensitive drums 1Y, 1M, 1C, and 1K is irradiated through a plurality of optical elements with the laser beam L deflected by a rotating polygon mirror.

Then, toner images of different colors are formed on the photosensitive drums 1Y, 1M, 1C, and 1K through the developing process, and are transferred onto the intermediate transfer belt 8 to be superimposed thereon. Thus, a color image is formed on the intermediate transfer belt 8.

Figure 3:
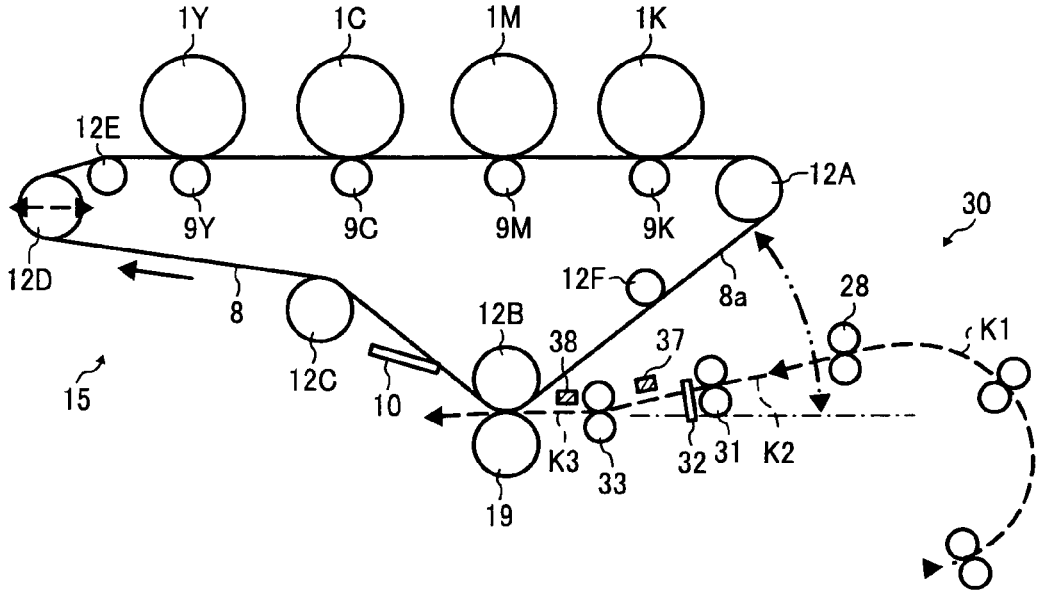
FIG. 3 is a schematic diagram of a conveying unit and its neighborhood shown in FIG. 1.

As shown in FIG. 3, the intermediate transfer belt device 15 includes the intermediate transfer belt 8, transfer rollers 9Y, 9M, 9C, and 9K, a driving roller 12A, an opposing roller 12B, supporting rollers 12C to 12F, and an intermediate-transfer cleaning unit 10. While stretched over and supported by the rollers 12A to 12F, the intermediate transfer belt 8 endlessly moves in a direction indicated by an arrow in FIG. 3 with rotation of the driving roller 12A.

The transfer rollers 9Y, 9M, 9C, and 9K and the photosensitive drums 1Y, 1M, 1C, and 1K form primary transfer nips with the intermediate transfer belt 8 therebetween. A transfer voltage (transfer bias) with a polarity opposite to that of toner is applied to the transfer rollers 9Y, 9M, 9C, and 9K.

The intermediate transfer belt 8 (belt-shaped image carrier) moves in the direction indicated by the arrow in FIG. 3 and passes the primary transfer nips in sequence between the transfer rollers 9Y, 9M, 9C, and 9K and the photosensitive drums 1Y, 1M, 1C, and 1K. Thus, toner images of different colors formed on the photosensitive drums 1Y, 1M, 1C, and 1K are primarily transferred onto the intermediate transfer belt 8 to be thereon.

With the rotation of the intermediate transfer belt 8, the superimposed toner images reach a position opposite to a secondary transfer roller 19. The secondary transfer roller 19 and the opposing roller 12B form a secondary transfer nip with the intermediate transfer belt 8 therebetween. The superimposed toner images on the intermediate transfer belt 8 is transferred (secondary transferred) as a color image onto a recording medium (sheet) P conveyed to the secondary transfer nip. At this time, residual toner remains on the intermediate transfer belt 8.

The residual toner is removed from the intermediate transfer belt 8 by the intermediate-transfer cleaning unit 10. In this manner, the transfer process is performed on the intermediate transfer belt 8.

As shown in FIG. 1, the sheet P is fed from a feed cassette 26 arranged at a lower portion of the image forming apparatus 100 (or a feed cassette on a side thereof) through a feeding roller 27 and the conveying unit 30, and conveyed to the secondary transfer nip.

Specifically, the feed cassette 26 contains a stack of sheets P. The feeding roller 27 picks a topmost sheet P from the stack and feeds it towards the conveying unit 30 while rotating counterclockwise in FIG. 1.

After the sheet P conveyed to the conveying unit 30 is subjected to skew correction (skew adjustment), lateral registration correction, i.e., correction of misalignment in a width direction, and longitudinal registration correction, i.e., correction of misalignment in a direction in which the sheet P is conveyed (conveying direction), the sheet P is conveyed to the secondary transfer nip in tune with a color image formed on the intermediate transfer belt 8. Thus, a desired color image is transferred onto the sheet P.

The sheet P is then conveyed to a fixing unit 20 including a fixing roller and a pressing roller, and the color image is fixed on the sheet P with heat and pressure applied by the rollers.

Then, the sheet P is discharged outside the image forming apparatus 100 by a pair of discharging rollers (not shown). The sheets P are thus sequentially stacked on a stacking unit as an output image.

In the first embodiment, process line speed (speed at which an intermediate transfer belt 8 moves or speed at which the sheet P is conveyed) of the image forming apparatus 100 is set to about 400 millimeters per second.

As shown in FIG. 2, the developing unit 5Y includes a developing roller 51Y facing the photosensitive drum 1Y, a doctor blade 52Y opposite to the developing roller 51Y, two conveying screws 55Y arranged in a developer container, a toner supply path 43Y that communicates to the developer container through its opening, and a concentration detecting sensor 56Y that detects a toner concentration in developer. The developing roller 51Y includes a magnet that is fixedly arranged therein, and a sleeve that rotates around the magnet. The developer container contains two-component developer formed of carrier and toner.

The sleeve rotates in a direction indicated by an arrow shown in FIG. 2. Developer carried on the developing roller 51Y due to a magnetic field formed by the magnet moves on the developing roller 51Y with rotation of the sleeve. Developer in the developing unit 5Y is adjusted to set a toner ratio (toner concentration) of the developer in a predetermined range.

While mixed and stirred with the developer by the conveying screws 55Y, toner supplied to the developer container circulates in two sections of the developer container (in the vertical direction with respect to a sheet surface of FIG. 2). The toner in the developer adheres to the carrier due to frictional charge with the carrier, and is carried on the developing roller 51Y with the carrier by a magnetic force formed on the developing roller 51Y.

The developer on the developing roller 51Y is conveyed in a direction indicated by the arrow shown in FIG. 2 and reaches the doctor blade 52Y at which, after an amount of the developer is properly adjusted, the developer is carried to a position (developing area) facing the photosensitive drum 1Y.

Then, the toner is adhered to a latent image formed on the photosensitive drum 1Y by an electric field formed on the developing area. Developer that remains on the developing roller 51Y reaches an upper portion of the developer container with rotation of the sleeve, and is removed from the developing roller 51Y.

Figure 4:
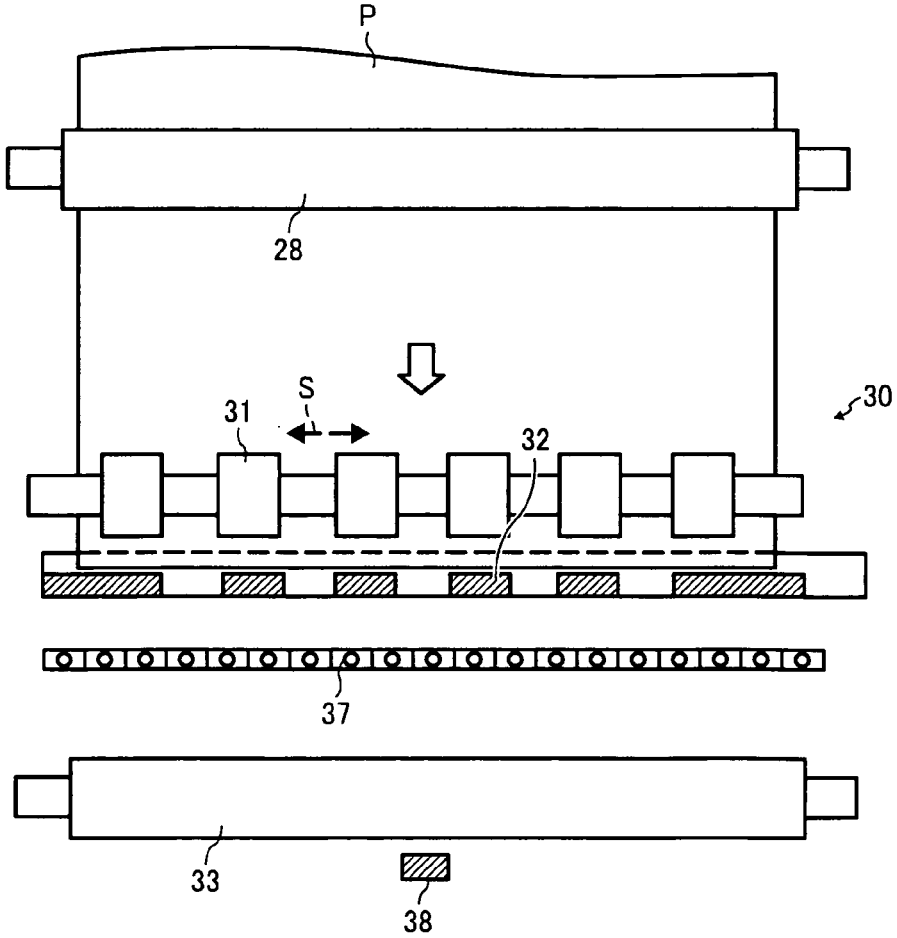
FIG. 4 is a top view of the conveying unit.

As shown in FIGS. 3 and 4, the conveying unit 30 includes, along a conveying path of a sheet (indicated by a broken line in FIG. 3), conveying rollers 28, holding rollers 31 serving as a lateral registration correcting unit, an aligning member 32, and registration rollers 33 serving as a longitudinal registration correcting unit. A contact image sensor 37 (CIS) is arranged between the aligning member 32 and the registration rollers 33. A photosensor 38 is arranged between the registration rollers 33 and the secondary transfer nip.

The intermediate transfer belt 8 is arranged such that a belt surface 8*a* slopes downward from upstream in the conveying direction to the secondary transfer nip. In other words, as shown in FIG. 3, part of the intermediate transfer belt 8 between the driving roller 12A and the opposing roller 12B slopes downward to the left.

In the conveying unit 30 is arranged a linear conveying path K2 at upstream of the secondary transfer nip in the conveying direction, below the sloped belt surface 8*a* and above a horizontal line passing through the secondary transfer nip (a one-dot chain line shown in FIG. 3). In other words, the conveying path K2 is arranged in a range indicated by a two-dot chain arrow shown in FIG. 3 (a range that is not overlapped by the horizontal line or the belt surface 8*a*).

With this, compared with a case in which a conveying path is horizontal toward the secondary transfer nip or a conveying path is slopes upward, it is possible to more effectively use a space between the intermediate transfer belt 8 (the belt surface 8*a*) and the conveying unit 30. That is, it is possible to achieve a more compact image forming apparatus.

More specifically, the conveying unit 30 includes the registration rollers 33 to correct longitudinal registration at upstream of the secondary transfer nip in the conveying direction. The linear conveying path K2 is arranged upstream of the registration rollers 33 in the conveying direction and is formed to slope downward from upstream toward the secondary transfer nip. In addition, a conveying path K3 is formed to be level in a range from the registration rollers 33 to the secondary transfer nip.

This configuration makes it possible to reduce a useless space between the intermediate transfer belt 8 and the conveying unit 30 as well as to achieve stable secondary transfer because a sheet does not enter into the secondary transfer nip at a sharp angle.

The conveying unit 30 further includes a curved conveying path K1, along which a sheet is curved and conveyed, at upstream of the linear conveying path K2 (sloped) in the conveying direction. This makes a conveying path from the feed cassette 26 to the sloped conveying path K2 shorter without decreasing sheet-conveying performance.

The conveying rollers 28 are arranged upstream of the holding rollers 31 in the conveying direction on the sloped conveying path K2. The conveying rollers 28 are arranged one upon the other configured such that they can be into contact with or separate from each other by a driving mechanism (not shown).

The aligning member 32 is formed of a metal plate having a surface (divided into a plurality of portions in a width direction) into which the leading edge of a sheet bumps, so that skew (slanting) and longitudinal registration of the sheet is corrected. The aligning member 32 is arranged on the sloped conveying path K2, and can open or close the conveying path. Specifically, a cam mechanism (not shown) that engages with the aligning member 32 is driven to move the aligning member 32 upward in FIG. 3 at a predetermined timing to close the aligning member 32, or downward in FIG. 3 to open the conveying path.

The holding rollers 31 constitute a roller unit and are arranged in the width direction on the sloped conveying path K2 at upstream of the aligning member 32 in the conveying direction. The holding rollers 31 are moved up and down by a driving mechanism (not shown) so that the holding rollers 31 can be into contact with or separate from each other and be moved in a width direction (S direction indicated by a two-headed broken line arrow shown in FIG. 4). The holding rollers 31 holds a sheet abutting the aligning member 32, and then moves in the width direction to correct lateral registration of the sheet.

Thus, it is possible to effectively use a space between the intermediate transfer belt 8 and the conveying unit 30 by arranging the conveying rollers 28, the aligning member 32, and the holding rollers 31 on the sloped conveying path K2. Moreover, when the conveying rollers 28, the aligning member 32, and the holding rollers 31 are arranged on the linear conveying path K2, compared with a case in which they are arranged on a curved conveying path, it is possible to increase accuracy in longitudinal registration correction, lateral registration correction, and skew correction.

The registration rollers 33 are arranged downstream of the aligning member 32 in the conveying direction. After lateral registration is corrected by the holding rollers 31, a sheet bumps into a nip between the registration rollers 33. Accordingly, longitudinal registration of the sheet is corrected. In addition, the leading edge of the sheet bumps into the registration rollers 33, which corrects skew of the sheet.

The CIS 37 is formed of a plurality of photosensors (including a light-emitting element such as a light emitting diode (LED) and a light-receiving element such as a photodiode) arranged in parallel in the width direction. The CIS 37 detects both edges of a sheet in the width direction to detect an amount by which the sheet shifts in lateral registration. Lateral registration is corrected by the holding rollers 31 based on a result detected by the CIS 37.

The photosensor 38 is arranged downstream of the registration rollers 33 in the conveying direction, and optically detects the leading edge of a sheet conveyed from the registration rollers 33. Then, a timing at which the sheet is conveyed by the registration rollers 33 toward the secondary transfer nip is finely adjusted based on a result detected by the photosensor 38.

Figure 5A:
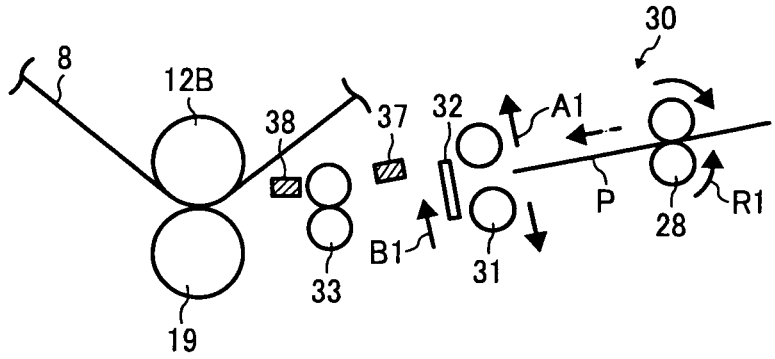
FIGS. 5A to 5D are schematic diagrams for explaining the operation of the conveying unit.

As shown in FIG. 5A, a sheet P fed from the feed cassette 26 is conveyed toward the aligning member 32 (in a direction indicated by a broken-line arrow) with rotation of the conveying rollers 28 in R1 direction. At this time, the holding rollers 31 move in A1 direction to open the conveying path. The aligning member 32 moves in B1 direction to close the conveying path.

Figure 5B:
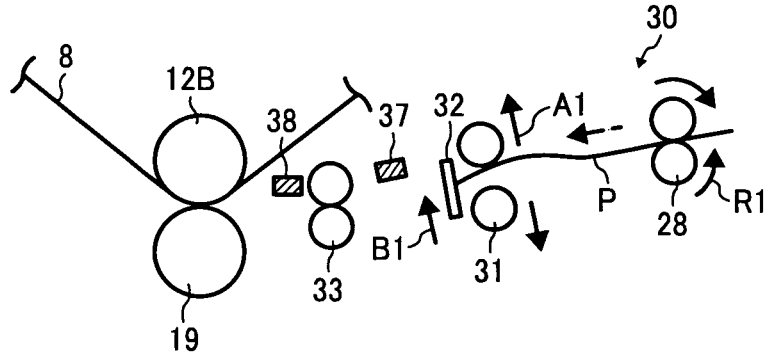
Figure 5C:
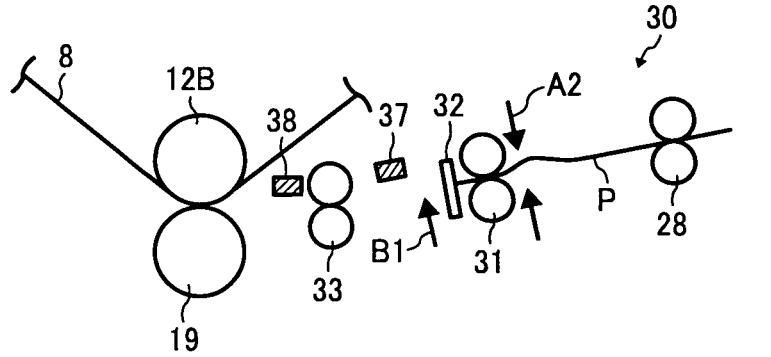

As shown in FIG. 5B, the leading edge of the sheet P bumps into the aligning member 32, and the sheet P stops. As shown in FIG. 5C, when the conveying rollers 28 stop rotating, the holding rollers 31 move in A2 direction to hold the sheet P. Then, part of the sheet P deforms.

Thus, the leading edge of the sheet P bumps into the aligning member 32, whereby skew (slanting) of the sheet P is corrected. In other words, if the sheet P is conveyed askew (skewed) with respect to the conveying direction, part of the leading edge of the sheet P first bumps into the aligning member 32, and then, the other part also bumps into the aligning member 32 along with the first part. Consequently, skew of the sheet P is corrected.

Longitudinal registration of the sheet P is then corrected. Specifically, the holding rollers 31 rotates in timing with a color image on the intermediate transfer belt 8, and the sheet P is conveyed to the registration rollers 33.

Figure 5D:
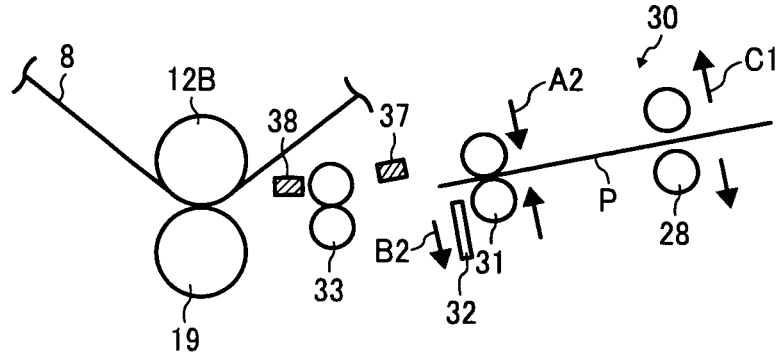

As shown in FIG. 5D, along with movement of the conveying rollers 28 in a direction (C1 direction) to open the conveying path, the aligning member 32 moves in a direction (B2 direction) to open the conveying path. With this, the sheet P is held by the holding rollers 31 alone.

Figure 6A:
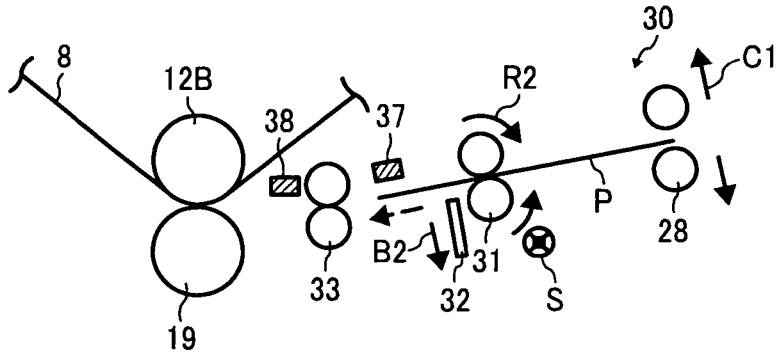
FIGS. 6A to 6D are schematic diagrams for explaining the operation of the conveying unit after that shown in FIGS. 5A to 5D.

As shown in FIG. 6A, then, the sheet P is conveyed to the registration rollers 33 (in a direction indicated by a broken-line arrow) based on rotation of the holding rollers 31 in R2 direction. At this time, the CIS 37 detects an amount by which the sheet P shifts in lateral registration, and the holding rollers 31 move in a vertical direction with respect to a sheet surface (S direction) to offset the amount. For example, as shown in FIG. 4, when the sheet P shifts by only three millimeters to the right in lateral registration, the holding rollers 31 that hold the sheet P are shifted by only three millimeters to the left.

Figure 6B:
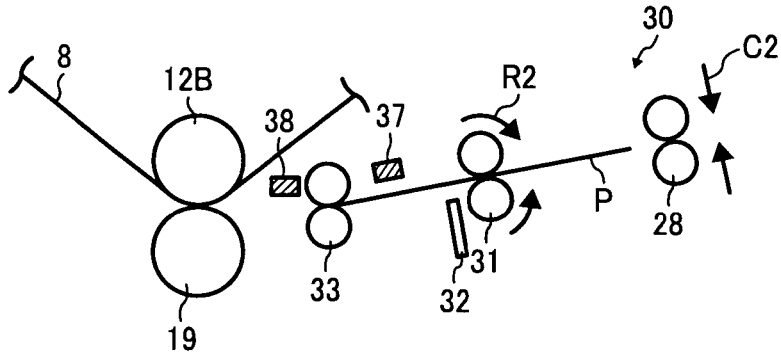

As shown in FIG. 6B, the leading edge of the sheet P of which lateral registration has been corrected bumps into the registration rollers 33, and the sheet P stops. The conveying rollers 28 move in the conveying direction (C2 direction) to be ready for the following sheet.

Figure 6C:
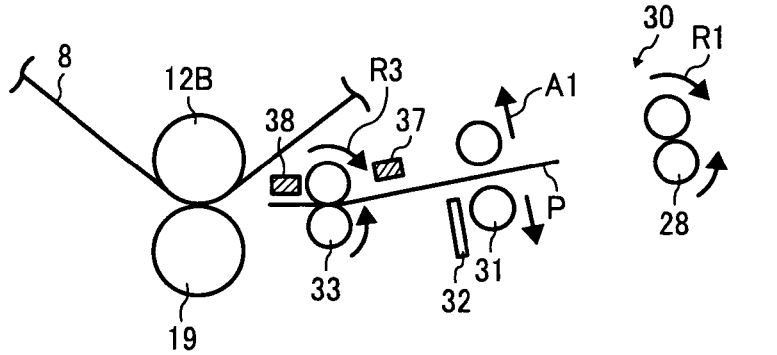

As shown in FIG. 6C, when the conveying rollers 28 resume rotating, the holding rollers 31 move in a direction of releasing the sheet P (A1 direction). When the registration rollers 33 rotate and the photosensor 38 detects the leading edge of the sheet P, the registration rollers 33 temporarily stops rotating.

Figure 6D:
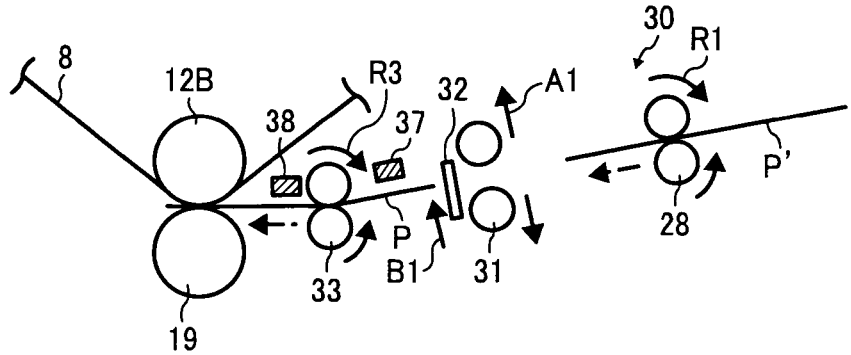

Longitudinal registration of the sheet P is then corrected. As shown in FIG. 6D, the sheet P is conveyed to the secondary transfer nip in tune with a color image on the intermediate transfer belt 8. Thus, a color image is transferred onto a desired position of the sheet P.

The number of revolutions of the registration rollers 33 can be changed by driving a variable driving motor (not shown). This makes it possible to adjust conveyance speed of a sheet conveyed from the registration rollers 33 to the secondary transfer nip, and adjust longitudinal registration more accurately.

The aligning member 32 moves in a direction of closing the conveying path (B1 direction) to be ready for skew correction with respect to the following sheet P' conveyed by the conveying rollers 28.

As described above, according to the first embodiment, the image forming apparatus 100 includes the linear conveying path K2 that extends alongside the belt surface 8*a* at upstream of the secondary transfer nip in the conveying direction. Therefore, it is possible to achieve space saving.

While, in the first embodiment, the image forming apparatus 100 includes the intermediate transfer belt 8 as a belt-shape image carrier, the belt-shape image carrier can be a photosensitive belt. In this case also, a conveying path is formed along a sloped surface of the photosensitive belt in a conveying unit in which a sheet is conveyed to an image transfer unit that transfers an image formed on the photosensitive belt onto a sheet. With this, it is possible to obtain the same effects as in the first embodiment.

Figure 7:
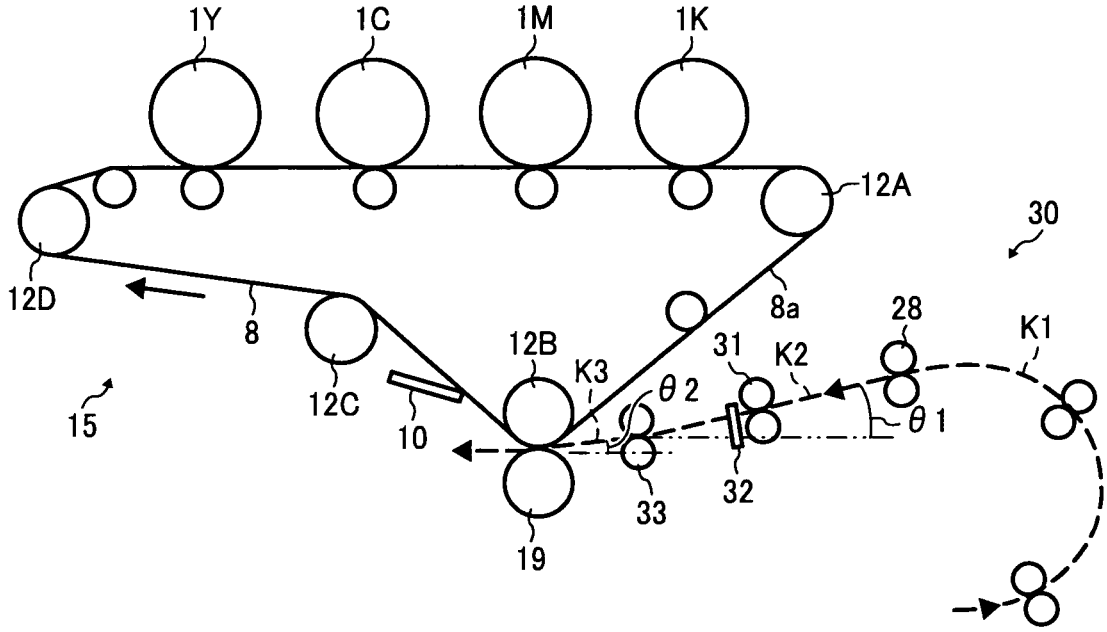
FIG. 7 is a schematic diagram of a conveying unit according to a second embodiment of the present invention.

FIG. 7 is a schematic diagram of the conveying unit 30 according to a second embodiment of the present invention. An image forming apparatus of the second embodiment is basically similar to that of the first embodiment except for the level conveying path K3. That is, the conveying path K3 of the first embodiment extends horizontally, while that of the second embodiment slopes from the registration rollers 33 to the image transfer unit.

As shown in FIG. 7, the intermediate transfer belt 8 also has the belt surface 8*a* that slopes downward from upstream of the secondary transfer nip in the conveying direction. The conveying unit 30' includes the linear conveying path K2 (sloped conveying path) that slopes at a predetermined angle θ1 alongside the sloped belt surface 8*a*.

The conveying path K3 is formed to slope at an angle θ2 smaller than θ1 (θ2<θ1).

This configuration makes it possible to reduce a useless space between the intermediate transfer belt 8 and the conveying unit 30 as in the first embodiment. Moreover, a sheet does not enter into the secondary transfer nip at a sharp angle, which leads to a stable secondary transfer.

As described above, according to the second embodiment, the linear conveying path K2 is arranged alongside the belt surface 8*a* at upstream of the secondary transfer nip in the conveying direction. Thus, it is possible to achieve space saving as in the first embodiment.

Figure 8:
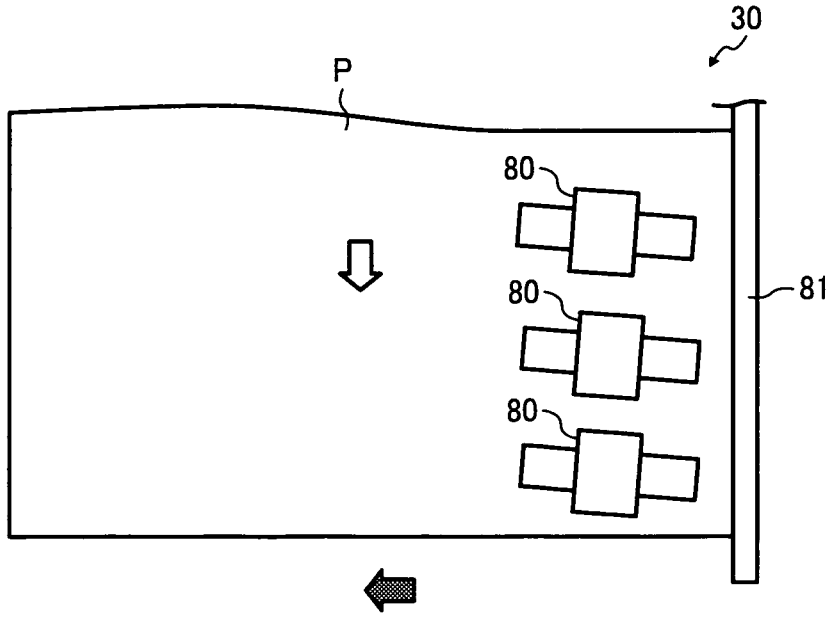
FIG. 8 is a top view of part of a conveying unit according to a third embodiment of the present invention.

FIG. 8 is a top view of part of the conveying unit 30 according to a third embodiment of the present invention. The conveying unit 30 of the third embodiment is basically similar to that of the first embodiment except that tilting rollers 80 are arranged as a lateral registration correcting unit instead of the holding rollers 31.

The intermediate transfer belt 8 also has the belt surface 8*a* that slopes downward from upstream of the secondary transfer nip in the conveying direction. The sloped linear conveying path K2 is arranged alongside the sloped belt surface 8*a* in the conveying unit 30.

The tilting rollers 80, as a lateral registration correcting unit arranged on the sloped conveying path K2, are arranged askew with respect to the conveying direction indicated by a white arrow in FIG. 8. The tilting rollers 80 are arranged along a guiding member 81 at an end of the conveying path K2 in its width direction.

The tilting rollers 80 rotate for a predetermined time, so that a sheet P moving along the guiding member 81 on the conveying path K2 shifts by a predetermined distance in a direction indicated by a black arrow. Thus, lateral registration of the sheet P is corrected. The time to drive the tilting rollers 80 is variably controlled based on a result detected by the CIS 37.

As described above, according to the third embodiment, the linear conveying path K2 is arranged alongside the belt surface 8*a* at upstream of the secondary transfer nip in the conveying direction. Thus, it is possible to achieve space saving as in the first and second embodiments.

In the above embodiments, the number, position, shape, etc. of the components are cited by way of example and without limitation, and can be changed as required.

As set forth hereinabove, according to an aspect of the present invention, a linear conveying path is arranged alongside a surface of an belt-shaped image carrier at upstream of an image transfer unit in a direction in which a recording medium is conveyed. Thus, it is possible to achieve space saving.

Although the invention has been described with respect to specific embodiments for a complete and clear disclosure, the appended claims are not to be thus limited but are to be construed as embodying all modifications and alternative constructions that may occur to one skilled in the art that fairly fall within the basic teaching herein set forth.

What is claimed is:

1. An image forming apparatus, comprising:

an image carrier that moves in a set direction while carrying an image;

a transfer unit that transfers the image carried on the image carrier onto a recording medium;

a conveying unit that conveys the recording medium to the transfer unit; and a feeding unit that is arranged below a horizontal line passing through the transfer unit, wherein:

the image carrier has a sloping surface that slopes down from upstream of the transfer unit in a conveying direction in which the recording medium is conveyed, the conveying unit, arranged upstream of the transfer unit in the conveying direction between the sloping surface and the horizontal line, configured to move the recording medium along a first conveying path region, a second conveying path region, and a third conveying path region, the recording medium further moving from the feeding unit to the second conveying path region to the first conveying path region so as to cross the horizontal line from a side of the feeding unit to a side of the first conveying path region and then to the third conveying path region, which is in parallel to the horizontal line, the second conveying path region is curved and begins below the horizontal line, crosses the horizontal line and ends above the horizontal line, connecting to the first conveying path region, the first conveying path region is linear and slopes down toward the transfer unit and a width of the first conveying path region is longer than the second and third conveying path regions in the conveying direction in a cross section perpendicular to the horizontal line, and the conveying unit further includes a first correcting unit and a second correcting unit disposed in the first conveying path region.

2. The image forming apparatus according to claim 1, wherein the conveying unit is arranged upstream of the transfer unit in the conveying direction and corrects misalignment of the recording medium in the conveying direction, so that the recording medium moves in the first conveying path region which is provided upstream of the first correcting unit in the conveying direction and slopes down toward the first correcting unit.

3. The image forming apparatus according to claim 2, wherein the first correcting unit includes a registration roller.

4. The image forming apparatus according to claim 2, wherein the first correcting unit includes a registration roller to correct longitudinal registration at upstream of the transfer unit in the conveying direction.

5. The image forming apparatus according to claim 4, wherein the first conveying path region is provided upstream of the registration rollers in the conveying direction, and configured to move the recording medium downward toward the transfer unit in a slope manner.

6. The image forming apparatus according to claim 5, wherein the third conveying path region is formed to be level in a range from the registration rollers to the transfer unit.

7. The image forming apparatus according to claim 1, wherein the conveying unit is arranged upstream of the transfer unit in the conveying direction and corrects misalignment of the recording medium in the conveying direction, so that the recording medium moves in the first conveying path region which is provided upstream of the first correcting unit in the conveying direction and slopes at an angle toward the first correcting unit, and the conveying unit further moves the recording medium along the third conveying path region sloping at a smaller angle than an angle between the third conveying path region and the first conveying path region.

8. The image forming apparatus according to claim 1, wherein the second correcting unit moves the recording medium along the first conveying path region to correct misalignment of the recording medium in a width direction of the recording medium.

9. The image forming apparatus according to claim 8, wherein the conveying unit includes an aligning member, in which the recording medium moves along the first conveying path region to bump a leading edge of the recording medium moving on the first conveying path region, and the second correcting unit is arranged upstream of the aligning member in the conveying direction, and moves in the width direction while holding the recording medium abutting the aligning member.

10. The image forming apparatus according to claim 8, wherein the second correcting unit is tilting rollers arranged askew with respect to the conveying direction.

11. The image forming apparatus according to claim 8, wherein the conveying unit includes conveying rollers that are arranged upstream of the second correcting unit in the conveying direction on the first conveying path region for conveying the recording medium.

12. The image forming apparatus according to claim 1, wherein the conveying unit further includes conveying rollers, holding rollers, an aligning member, and registration rollers.

13. The image forming apparatus according to claim 12, wherein the aligning member is arranged on the sloped first conveying path region.

14. The image forming apparatus according to claim 13, wherein the aligning member is a metal plate having a surface into which a leading edge of the recording member bumps thereto, so that skew and longitudinal registration of the recording medium is corrected.

15. The image forming apparatus according to claim 12, wherein the holding rollers are arranged in a width direction on the first conveying path region at upstream of the aligning member in the conveying direction.

16. The image forming apparatus according to claim 15, wherein the holding rollers move up and down so that the holding rollers can be moved into contact with or separate from each other and be moved in the width direction.

17. The image forming apparatus according to claim 16, wherein the holding rollers hold the recording medium abutting the aligning member, and move in the width direction to correct lateral registration of the recording medium.

18. The image forming apparatus according to claim 1, wherein the second conveying path region includes rollers that are arranged above the horizontal line for conveying the recording medium obliquely upward with respect to the horizontal line.

19. The image forming apparatus according to claim 1, further comprising registration rollers arranged between the first conveying path region and the transfer unit for conveying the recording medium toward the transfer unit while causing the recording medium being conveyed in a slope manner along the first conveying path region to be nearly parallel to the horizontal line.

20. An image forming apparatus, comprising:

at least one image carrier that moves in a set direction while carrying an image;

a transfer unit that transfers the image carried on the at least one image carrier onto a recording medium;

a conveying unit that conveys the recording medium to the transfer unit; and a feeding unit that is arranged below a horizontal line passing through the transfer unit, wherein:

the conveying unit, arranged upstream of the transfer unit in the conveying direction, configured to move the recording medium along a first conveying path region, a second conveying path region, and a third conveying path region, the recording medium further moving from the feeding unit to the second conveying path region to the first conveying path region so as to cross the horizontal line from a side of the feeding unit to a side of the first conveying path region and then to the third conveying path region, which is in parallel to the horizontal line, the second conveying path region is curved and begins below the horizontal line, crosses the horizontal line and ends above the horizontal line, connecting to the first conveying path region, the first conveying path region is linear and slopes down toward the transfer unit and a width of the first conveying path region is longer than the second and third conveying path regions in the conveying direction in a cross section perpendicular to the horizontal line, and the conveying unit further includes a first correcting unit and a second correcting unit disposed in the first conveying path region.

21. The image forming apparatus according to claim 17, wherein the at least one image carrier is oriented toward the transfer unit from a vertically upstream side in the transfer direction.

22. An image forming apparatus, comprising:

an image forming unit that forms an image onto a recording medium;

a conveying unit that conveys the recording medium to the image forming unit; and a feeding unit that is arranged below a horizontal line passing through the image forming unit, wherein:

the conveying unit, arranged upstream of the image forming unit in the conveying direction, configured to move the recording medium along a first conveying path region, a second conveying path region, and a third conveying path region, the recording medium further moving from the feeding unit to the second conveying path region to the first conveying path region so as to cross the horizontal line from a side of the feeding unit to a side of the first conveying path region and then to the third conveying path region, which is in parallel to the horizontal line, the second conveying path region is curved and begins below the horizontal line, crosses the horizontal line and ends above the horizontal line, connecting to the first conveying path region, the first conveying path region is linear and slopes down toward the image forming unit and a width of the first conveying path region is longer than the second and third conveying path regions in the conveying direction in a cross section perpendicular to the horizontal line, and the conveying unit further includes a first correcting unit and a second correcting unit disposed in the first conveying path region.

* * * * *